US010124387B2

(12) United States Patent
Nakazawa et al.

(10) Patent No.: US 10,124,387 B2
(45) Date of Patent: Nov. 13, 2018

(54) PRESS-MOLDED PRODUCT, PRESS-MOLDED PRODUCT PRODUCING METHOD, AND PRESS-MOLDED PRODUCT PRODUCING APPARATUS

(71) Applicant: NIPPON STEEL & SUMITOMO METAL CORPORATION, Tokyo (JP)

(72) Inventors: Yoshiaki Nakazawa, Tokyo (JP); Yasuhiro Ito, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 269 days.

(21) Appl. No.: 14/911,587

(22) PCT Filed: Aug. 26, 2014

(86) PCT No.: PCT/JP2014/072281

§ 371 (c)(1),
(2) Date: Feb. 11, 2016

(87) PCT Pub. No.: WO2015/041009

PCT Pub. Date: Mar. 26, 2015

(65) Prior Publication Data

US 2016/0193644 A1 Jul. 7, 2016

(30) Foreign Application Priority Data

Sep. 20, 2013 (JP) ..... 2013-195951

(51) Int. Cl.
*B21D 22/02* (2006.01)
*B21D 22/20* (2006.01)
(Continued)

(52) U.S. Cl.
CPC ..... *B21D 22/02* (2013.01); *B21D 22/20* (2013.01); *B21D 22/26* (2013.01); *B21D 53/88* (2013.01)

(58) Field of Classification Search
None
See application file for complete search history.

(56) References Cited

FOREIGN PATENT DOCUMENTS

FR 838735 A 3/1939
JP 59-144530 A 8/1984
(Continued)

OTHER PUBLICATIONS

Official Action dated Oct. 4, 2017, in Russian Patent Application No. 2016109805, with partial English translation.
International Search Report, issued in PCT/JP2014/072281, dated Nov. 25, 2014.
Written Opinion of the International Searching Authority, issued in PCT/JP2014/072281(PCT/ISA/237), dated Nov. 25, 2014.
English translation of FR 838735, Mar. 14, 1939.
English translation of JP S60-131226, Sep. 3, 1985.

*Primary Examiner* — Adam Krupicka
(74) *Attorney, Agent, or Firm* — Birch, Stewart, Kolasch & Birch, LLP

(57) ABSTRACT

[Object] To provide a press-molded product including an inward continuous flange and capable of improving performance involved with the bonding strength between a reinforcing member and the other member or the rigidity of a vehicle body without forming a notch in a ridge-portion flange so as to prevent a defect generated during a press-molding process.
[Solution] Provided is a press-molded product of a metal plate which is formed by a steel plate having a tensile strength of 340 MPa or more and includes a ridge portion extending in a predetermined direction and first and second surface portions respectively extending from both ends of a ridge line formed by the ridge portion, the press-molded product including: an inward continuous flange which is obtained by continuously forming a ridge-portion flange formed inward in an end portion of the ridge portion, a first
(Continued)

flange formed inward in at least a part of an area of an end portion of the first surface portion, and a second flange formed inward in at least a part of an area of an end portion of the second surface portion. Regarding a plate thickness of an edge portion of the ridge-portion flange, the ridge-portion flange has a plate thickness distribution in which a plate thickness of a portion of each of areas on both sides of a circumferential center area is equal to or larger than a plate thickness of the center area.

6 Claims, 15 Drawing Sheets

(51) Int. Cl.
*B21D 22/26* (2006.01)
*B21D 53/88* (2006.01)

(56) References Cited

FOREIGN PATENT DOCUMENTS

| | | | |
|---|---|---|---|
| JP | 60-131226 | U | 9/1985 |
| JP | 1-104420 | A | 4/1989 |
| JP | 4-118118 | A | 4/1992 |
| JP | 5-338504 | A | 12/1993 |
| JP | 2554768 | B2 | 11/1996 |
| JP | 2560416 | B2 | 12/1996 |
| JP | 2000-301250 | A | 10/2000 |
| RU | 2 057 606 | C1 | 4/1996 |
| SU | 776712 | A1 | 11/1980 |
| SU | 1329868 | A1 | 8/1987 |

PRESS-MOLDED PRODUCT, PRESS-MOLDED PRODUCT PRODUCING METHOD, AND PRESS-MOLDED PRODUCT PRODUCING APPARATUS

TECHNICAL FIELD

The present invention relates to a press-molded product having excellent rigidity and strength and appropriately used as, for example, a vehicle body reinforcing member and also relates to a press-molded product producing method and a press-molded product producing apparatus used to produce the press-molded product.

BACKGROUND ART

A vehicle body has a structure in which a plurality of molding panels is bonded into a box shape by, for example, resistance spot-welding while edge portions of the molding panels overlap one another. A reinforcing member or a strengthening member (hereinafter, generally referred to as a "reinforcing member") is bonded to the box-shaped structure by, for example, resistance spot-welding. As such vehicle body reinforcing members, there are a bumper reinforcement, a locker (side sill), a beltline, a cross member, and a side member.

Each of these reinforcing members is formed as, for example, a press-molded member that has a substantially hat-shaped or groove-shaped cross-section and includes a ceiling plate, two ridge lines connected to the ceiling plate, and two flanges connected to two ridge lines. An end portion opened in the extension direction of the ridge line of such a reinforcing member is bent inward or outward so as to form a flange in the end portion. When the flange overlaps the other member and the flange and the other member are bonded to each other by, for example, resistance spot-welding, a vehicle body reinforcing member is assembled. Depending on the plate thickness of the material, arc-welding may be used instead of spot-welding.

Here, in the specification, an area in which an angle formed by two surfaces respectively connected to both ends of the ridge line is smaller than 180° will be referred to as an inner area, and a flange obtained by bending the end portion of the reinforcing member toward the inner area will be referred to as an inward flange. Further, an area in which an angle formed by two surfaces respectively connected to both ends of the ridge line is larger than 180° will be referred to as an outer area, and a flange obtained by bending the end portion of the reinforcing member toward the outer area will be referred to as an outward flange.

When the inward flange is formed in the end portion of the reinforcing member, a ridge-portion flange located on the extension line of the ridge line is molded as a flange by shrinking, and hence wrinkles are generated in the ridge-portion flange. For that reason, when such an inward flange overlaps the other member and the inward flange and the other member are bonded to each other by spot-welding, a gap is generated between the inward flange and the other member due to the wrinkles, and hence there is a concern that an assembling problem may occur. Thus, when the reinforcing member having the inward flange formed at the end portion is used, there is a need to weld the reinforcing member to the other member by using the inward flange as a bonding edge while avoiding the generation of wrinkles by, for example, forming a notch in the ridge-portion flange.

However, when the notch is formed in the inward ridge-portion flange so that the flange is not continuous, the performance of the vehicle body reinforcing member involved with torsional rigidity or load transfer efficiency is essentially degraded. Thus, in order to ensure the performance demanded for the reinforcing member by bonding the reinforcing member to the other member through the inward flange, there is a need to mold the shrinking flange while suppressing the generation of wrinkles in the ridge-portion flange without any notch formed in the inward flange.

In addition, in the specification, the "notch formed in the flange" indicates a state where the notch is formed in the entire flange in the width direction so that the flange is not continuous. Further, the width of the flange is used as the meaning of the height of the flange. Thus, when the width of the flange is partially decreased so that a part of the flange is left, the notch is not formed in the flange.

So far, a technique of suppressing the generation of wrinkles during the shrinking flange molding process has been proposed. For example, Patent Literature 1 discloses a technique of forming an unevenness shape, absorbing a difference in length between a front end portion and a base portion in a shrinking flange portion, in a roof panel having a sunroof opening. Further, Patent Literature 2 discloses a technique of preventing the generation of wrinkles by providing a specific drawing bead in a shrinking flange portion during a rectangular tube drawing process. Furthermore, Patent Literature 3 discloses a technique of suppressing the generation of wrinkles by performing a molding process while applying a pressure to a shrinking flange portion using a cam structure.

Further, Patent Literature 4 discloses a plate member molding method in which a flange corresponding portion extending in a direction interesting a bending load direction is formed in a portion to be used as a bent portion and the flange corresponding portion is stretched into a flange so as to have a desired shape. Such a plate member molding method is used to suppress tearing caused by the wrinkles in the flange.

Patent Literature 5 discloses a method in which a plane metal member is bent, upright portions of both side portions are bent outward, and both inclined side portions are strongly pressed by a processing roller of a pressing surface of a side surface of a receiving die so as to be sequentially raised. Such a processing method is used to reduce the distortion or the wrinkles of the upright portion.

PRIOR ART LITERATURE(S)

Patent Literature(s)

[Patent Literature 1] JP 2554768B
[Patent Literature 2] JP 2560416B
[Patent Literature 3] JP H4-118118A
[Patent Literature 4] JP S59-144530A
[Patent Literature 5] JP H1-104420A

SUMMARY OF THE INVENTION

Problem(s) to be Solved by the Invention

The techniques disclosed in Patent Literatures 1 and 2 are used to absorb the extra line length causing the generation of wrinkles and excessive padding by an excessive portion formed in advance. Thus, the spot-welding is not easily performed on the excessive portion and the excessive portion disturbs the spot-welding of the other portion. In such a case, it is difficult to perform the techniques disclosed in Patent Literatures 1 and 2.

Further, the technique disclosed in Patent Literature 3 can suppress the generation of wrinkles of the flange portion of the large-curvature-radius portion having, for example, a curvature radius of 2100 mm and having a feature that the shrinkage rate of the flange portion and the reaction force for the cam structure are small. However, it is difficult to suppress the generation of wrinkles of the flange portion of the small-curvature-radius portion having, for example, a curvature radius of 5 mm and having a feature that the shrinkage rate of the flange portion and the reaction force for the cam structure are large. Particularly, when a high-tensile steel plate having a large tensile strength is used, excessive wrinkles are generated, and hence the reaction force from the flange portion increases. For that reason, the cam structure disclosed in Patent Literature 3 cannot suppress the generation of wrinkles.

Further, the technique disclosed in Patent Literature 4 is used to suppress the generation of wrinkles by the stretching process. Thus, the plate thickness of the obtained flange is decreased. As a result, there is a concern that the rigidity of the reinforcing member or the strength of the flange portion may be degraded.

Further, the technique disclosed in Patent Literature 5 is used to form the upright portion by sequentially strongly pressing a plurality of processing rollers. Here, a product in which the curvature radius of the bent portion of the plane metal member is comparatively large is considered as a target. Thus, it is difficult to suppress the generation of wrinkles of, for example, the flange portion of the small-curvature-radius portion having a curvature radius of 5 mm.

In this way, in the member having a substantially hat-shaped or groove-shaped cross-section, it is difficult to form the inward flange without forming the notch in the end portion opened in the extension direction of the ridge portion from the viewpoint of press-moldability. Particularly, Patent Literatures 1 to 5 above are not contrived in consideration of the formation of the flange in the high-tensile steel plate having a tensile strength of 340 MPa or more. For that reason, there is no example in which a press-molded product formed by a high-tensile steel plate and including a continuous, inward flange without a notch in a ridge-portion flange is used as the vehicle body reinforcing member so far.

In a press-molded product having an outward flange, a hat-shaped or groove-shaped cross-section cannot be enlarged to the fullest extent of the design cross-section by the area of the outward flange. In other words, when the press-molded product can be bonded to the other member through the inward flange instead of the outward flange, the cross-section of the press-molded product can be enlarged to the fullest extent of the design cross-section by the area in which the outward flange is not provided. For that reason, it is possible to improve the bonding strength between the vehicle body reinforcing member and the other member or the bending rigidity or the torsional rigidity of the vehicle body. Thus, there is a desire to realize a press-molded product formed by a high-tensile steel plate and including an inward continuous flange.

An object of the invention is to provide a press-molded product including an inward continuous flange without a notch and capable of improving performance involved with the bonding strength between a reinforcing member and the other member or the rigidity of a vehicle body without forming a notch in a ridge-portion flange so as to prevent a defect generated during a press-molding process. Further, another object of the invention is to provide a press-molded product producing method and a press-molded product producing apparatus.

Means for Solving the Problem(s)

In order to solve the above problems, according to an aspect of the present invention, there is provided a press-molded product of a metal plate which is formed by a steel plate having a tensile strength of 340 MPa or more and includes a ridge portion extending in a predetermined direction and first and second surface portions respectively extending from both ends of a ridge line formed by the ridge portion, the press-molded product including: an inward continuous flange in at least one end portion in the predetermined direction. The inward continuous flange is obtained by continuously forming a ridge-portion flange formed inward in an end portion of the ridge portion, a first flange formed inward in at least a part of an area of an end portion of the first surface portion, and a second flange formed inward in at least a part of an area of an end portion of the second surface portion. Regarding a plate thickness of an edge portion of the ridge-portion flange, the ridge-portion flange has a plate thickness distribution in which a plate thickness of a portion of each of areas on both sides of a circumferential center area is equal to or larger than a plate thickness of the center area.

The ridge-portion flange may have a maximal plate thickness at three positions of the center area and the areas on the both sides, and the plate thickness of the positions of the areas on the both sides having a maximal plate thickness may be larger than the plate thickness of the position of the center area having a maximal plate thickness.

A flange width of at least a part of the ridge-portion flange may be smaller than a flange width of each of the first flange and the second flange.

A flange width (Lf) of the ridge-portion flange and a curvature radius (rf) of the ridge portion may satisfy Equation (1) below:

$$0.2\times rf \leq Lf \leq rf \quad (1).$$

A cross-section of the press-molded product when viewed in the predetermined direction may be a substantially hat-shaped or groove-shaped opened cross-section or a closed cross-section.

The press-molded product may be a vehicle body reinforcing member.

In order to solve the above problems, according to another aspect of the present invention, there is provided a press-molded product producing method for a work which is formed by a steel plate having a tensile strength of 340 MPa or more and includes a ridge portion extending in a predetermined direction and first and second surface portions respectively extending from both ends of a ridge line formed by the ridge portion, a flange being formed in at least one end portion of the work in the predetermined direction, the press-molded product producing method including: an installation step of supporting an area excluding the end portion of the work from an inner area of the work; and a bending step of, using a bending tool having a protrusion portion, bringing the protrusion portion into contact with a predetermined position of the ridge portion in the end portion of the work from an outer area of the work and then relatively moving the bending tool in a plate thickness direction of the predetermined position in a direction toward the inner area so as to form the flange.

In the bending step, the flange may be formed in a manner that the protrusion portion of the bending tool presses the predetermined position of the ridge portion in the end portion in accordance with the movement of the bending tool so as to bend the predetermined position in a plate thickness direction and then a portion other than the protrusion portion of the bending tool sequentially presses an other portion excluding the predetermined position in the end portion so as to bend the other portion in a plate thickness direction.

The predetermined position may be an area substantially having a width of a plate thickness and including a circumferential center portion and both sides of the circumferential center portion of the ridge portion. The protrusion portion may press the predetermined position in a plate thickness direction of the center portion.

In order to solve the above problems, according to still another aspect of the present invention, there is provided a press-molded product producing apparatus including: a work supporting tool which supports a work including a ridge portion extending in a predetermined direction and first and second surface portions respectively extending from both ends of a ridge line formed by the ridge portion from an inner area of the work; and a bending tool which relatively moves in a direction toward the inner area of the work while contacting an end portion of the work in the predetermined direction so as to bend the end portion in a direction toward the inner area. The bending tool includes a protrusion portion which contacts a predetermined position in the end portion of the ridge portion and presses the predetermined position in a plate thickness direction of the predetermined position in accordance with the movement.

When the bending tool is viewed in the predetermined direction, a width of the protrusion portion may decrease in a direction toward a front end portion and the front end portion may form a curve.

A height (h) of the protrusion portion and a curvature radius (rf) of the ridge portion may satisfy Equation (2) below:

$$0.5\times rf\leq h\leq 3.0\times rf \quad (2).$$

Effect(s) of the Invention

According to the invention, it is possible to suppress the generation of wrinkles in an inward continuous flange without forming a notch in a ridge-portion flange in order to prevent a defect generated during a press-molding process in a press-molded product formed by a high-tensile steel plate. Thus, when the press-molded product is used as a vehicle body reinforcing member, it is possible to improve performance involved with the bonding strength between the reinforcing member and the other member or the rigidity of a vehicle body.

BRIEF DESCRIPTION OF THE DRAWING(S)

Figure 14:
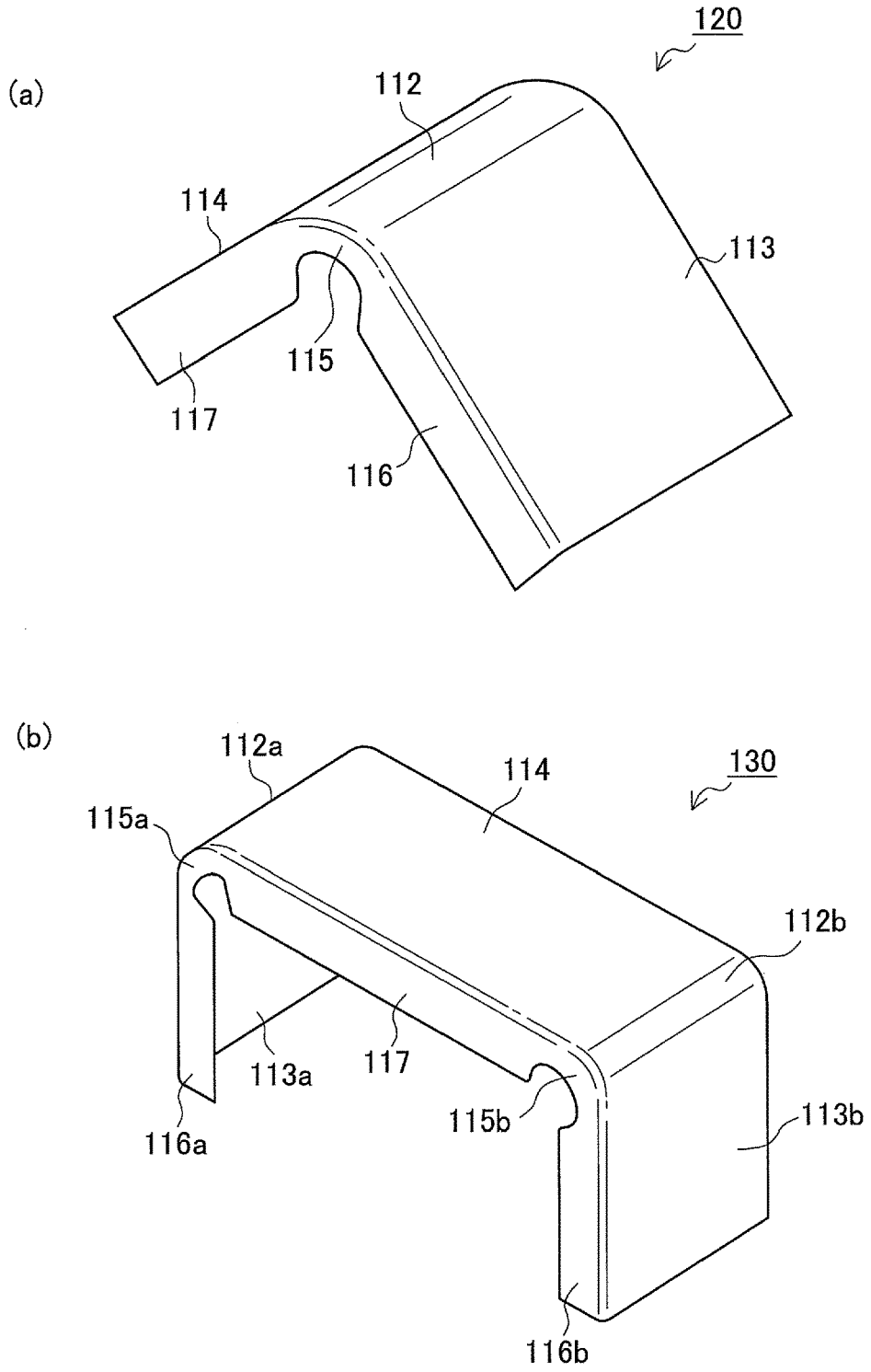

FIGS. 14(*a*) and 14(*b*) are external views illustrating a shape of a press-molded product having an inward continuous flange.

Figure 15:
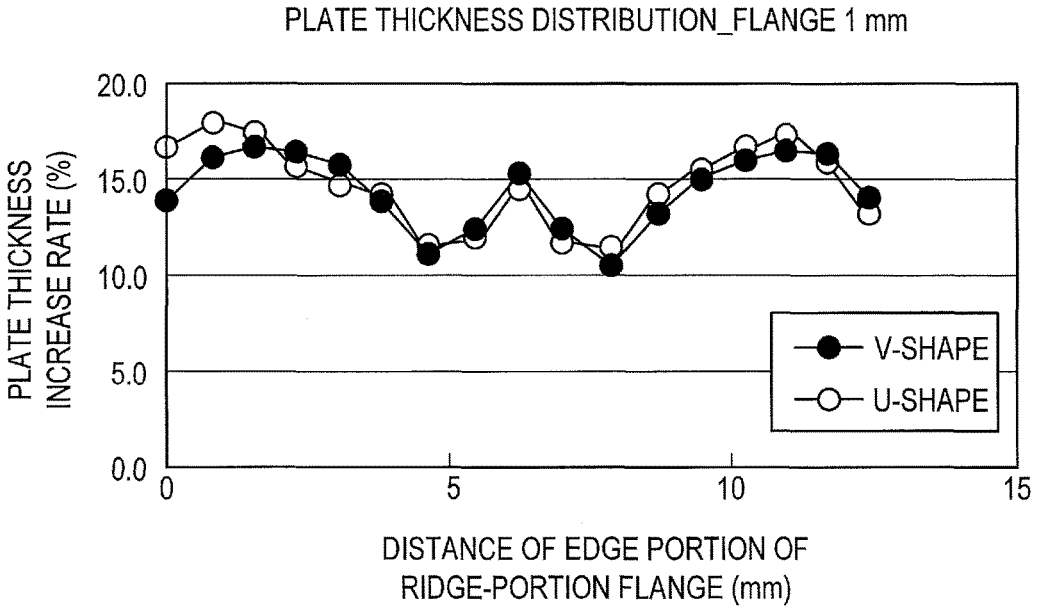

FIG. 15 is a graph illustrating a plate thickness distribution of a ridge-portion flange.

MODE(S) FOR CARRYING OUT THE INVENTION

Hereinafter, referring to the appended drawings, preferred embodiments of the present invention will be described in detail. It should be noted that, in this specification and the appended drawings, structural elements that have substantially the same function and structure are denoted with the same reference numerals, and repeated explanation thereof is omitted.

1. First Embodiment

First, a press-molded product according to a first embodiment of the invention will be described.

(1-1. Entire Configuration)

Figure 1:
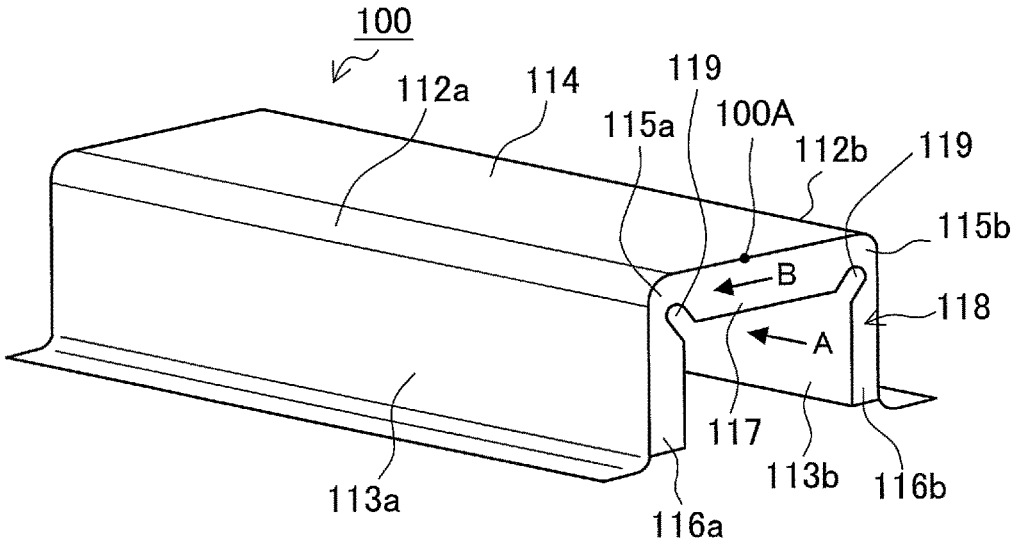
FIG. 1 is a perspective view schematically illustrating a press-molded product having a hat-shaped cross-section according to a first embodiment of the invention.
Figure 2:
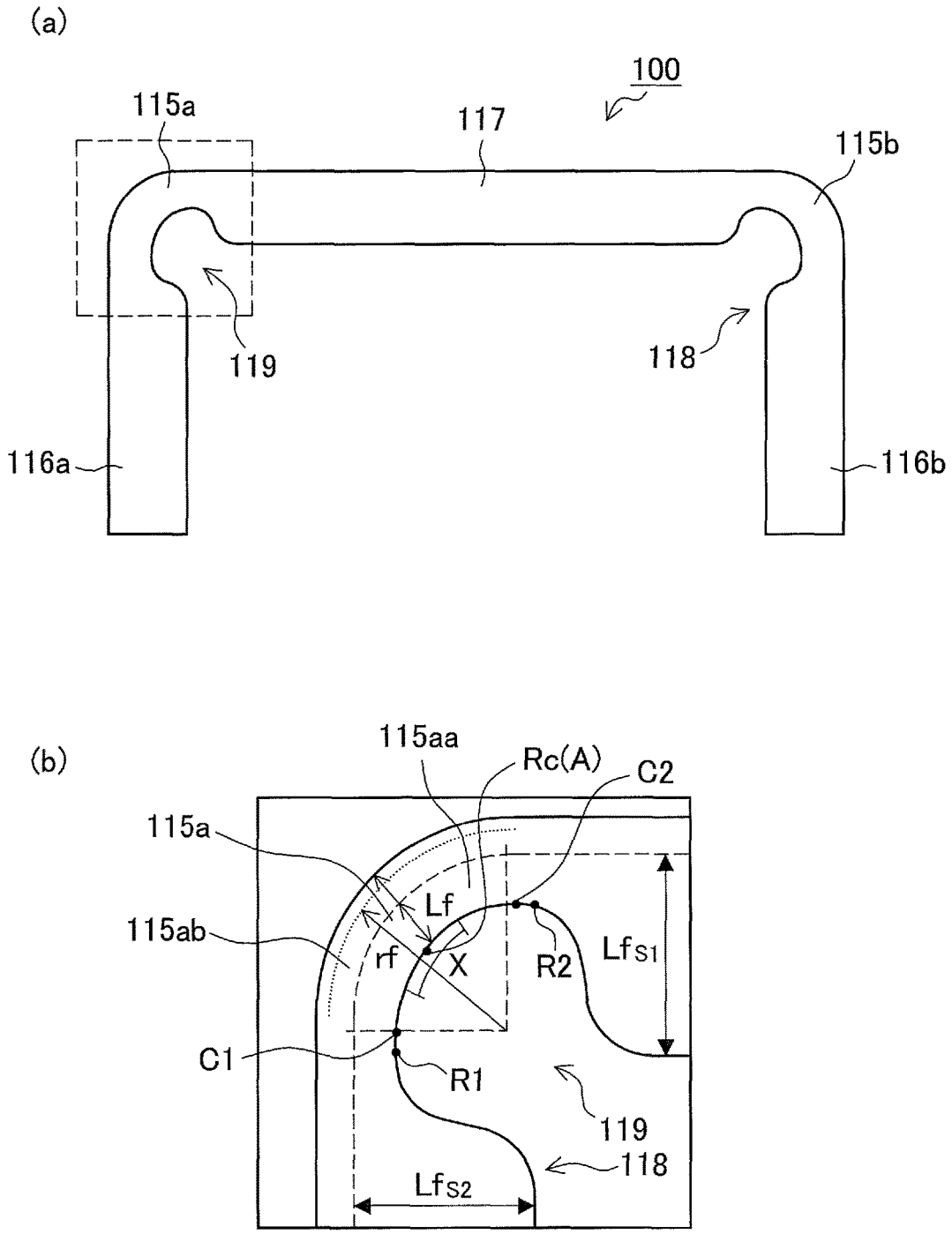
FIG. 2(*a*) is an explanatory diagram schematically illustrating a shape of an inward continuous flange and FIG. 2(*b*) is an explanatory diagram illustrating a ridge-portion flange when viewed from the front side.

FIG. 1 is a perspective view schematically illustrating a press-molded product 100 according to the embodiment. FIG. 2(*a*) is an explanatory diagram schematically illustrating a shape of an inward continuous flange 118 of the press-molded product 100. FIG. 2(*b*) is a view (a front view of a ridge-portion flange 115*a*) when viewed from A in FIG. 1 and is an enlarged view of an area surrounded by the dashed line in FIG. 2(*a*).

The press-molded product 100 according to the embodiment is a press-molded product of a metal plate which is formed by a high-tensile steel plate having a tensile strength of 340 MPa or more and includes ridge portions 112*a* and 112*b* which extend in a predetermined direction and first surface portions 113*a* and 113*b* and a second surface portion 114 which respectively extend from both ends of the ridge lines formed by the ridge portions 112*a* and 112*b*.

Such a press-molded product 100 includes, in at least one end portion in a predetermined direction, the inward continuous flange 118 obtained by continuously forming ridge-portion flanges 115*a* and 115*b* which are formed in the end portions of the ridge portions 112*a* and 112*b* so as to be directed inward, first flanges 116*a* and 116*b* which are formed in at least a part of the area of the end portions of the first surface portions 113*a* and 113*b* so as to be directed inward, and a second flange 117 which is formed in at least a part of the area of the end portion of the second surface portion 114 so as to be directed inward.

Regarding the plate thickness of the edge portions of the ridge-portion flanges 115*a* and 115*b* of the press-molded product 100, the ridge-portion flanges 115*a* and 115*b* have a plate thickness distribution in which portions of areas on both sides of the center area in the circumferential direction have plate thicknesses equal to or larger than the plate thickness of the center area. For example, as illustrated in FIG. 2(*b*), the center area of the edge portion of the ridge-portion flange 115*a* in the circumferential direction is defined as an area X including a center portion Rc as the intermediate point of positions R1 and R2 in which the plate thickness starts to increase from both ends of the edge portion of the ridge-portion flange 115*a* in the circumferential direction. Such a center area X can be set as a center area X when the area from the position R1 to the position R2 in the edge portion of the ridge-portion flange 115*a* is divided into three parts in the circumferential direction.

The press-molded product according to the embodiment is a molded product obtained by press-molding a steel plate. Such a press-molded product is suitable for, for example, a vehicle body reinforcing member such as a bumper reinforcement, a locker (side sill), a beltline, and a cross member. The press-molded product used for such an application may be obtained by press-molding a high-tensile steel plate having a tensile strength of 340 MPa or more and desirably 590 MPa or more. The tensile strength is a value measured by the tensile test based on JIS Z 2241. Further, the plate thickness of the blank formed by the steel plate may be, for example, in the range of 0.8 to 2.0 mm.

In the embodiment, the longitudinal direction of the press-molded product 100 or the blank corresponds to the extension direction of the ridge portions 112*a* and 112*b* of the press-molded product 100, but the extension direction of the ridge portions 112*a* and 112*b* is not limited to the longitudinal direction of the press-molded product 100. Further, in the embodiment, a predetermined direction in which the ridge portions 112*a* and 112*b* extend is not limited to a direction which is recognized as a straight line. A direction which is recognized as a curved shape (curve) other than the straight line found in many vehicle body reinforcing members is also included in the predetermined direction. When the predetermined direction is recognized as a curve, the predetermined direction includes, for example, a direction which is curved in the left and right direction or the up and down direction of the reinforcing member or a direction obtained by the combination of these directions. Further, the entire length in the predetermined direction includes, for example, all kinds of length from the length of about 1000 mm of a bumper or a side member to the length of about 100 mm of a cubic bulkhead.

Figure 3:
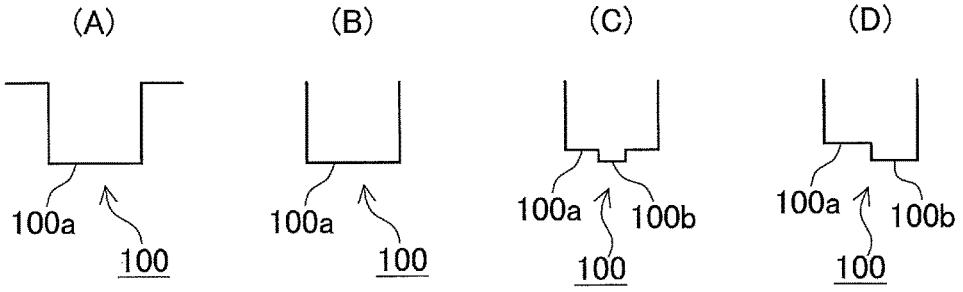
FIG. 3 is an explanatory diagram illustrating examples of cross-section shapes of press-molded products according to the same embodiment.

FIG. 3 is an explanatory diagram illustrating an example of a cross-section shape of the press-molded product 100 in a cross-section orthogonal to the longitudinal direction of the press-molded product 100. The cross-section shape of the press-molded product 100 according to the embodiment can be set to a hat-shaped cross-section illustrated in FIG. 3(A) or a groove-shaped cross-section illustrated in FIG. 3(B), but the invention is not limited thereto. As illustrated in FIG. 3(C) or 3(D), the cross-section shape of the press-molded product 100 includes a cross-section shape in which a convex shape 100*b* or a concave shape (not illustrated) is provided in a wall surface 100*a* in a hat-shaped or groove-shaped cross-section.

Further, the cross-section shape of the press-molded product 100 also includes, for example, a substantially rectangle-shaped closed cross-section shape other than the opened cross-section shapes illustrated in FIGS. 3(A) to 3(D). In addition, the press-molded product 100 is not limited to these cross-section shapes. For example, a press-molded product having a cross-section shape including a ridge portion and a first surface portion and a second surface portion respectively extending from both ends of the ridge line formed by the ridge portion and called a V-shaped cross-section may be used. The press-molded product 100 illustrated in FIG. 1 is the press-molded product 100 having a hat-shaped cross-section. Hereinafter, the press-molded product 100 having a hat-shaped cross-section will be described as an example.

As illustrated in FIG. 1, the press-molded product 100 includes the ridge portions 112*a* and 112*b*, the first surface portions 113*a* and 113*b*, and the second surface portion 114. Both ridge portions 112*a* and 112*b* are formed so as to extend in the longitudinal direction of the press-molded product 100. One first surface portion 113*a* is connected to the ridge portion 112*a* and is formed so as to extend in the first direction intersecting the longitudinal direction of the press-molded product 100. The other first surface portion 113*b* is connected to the ridge portion 112*b* and is formed so as to extend in the first direction intersecting the longitudinal direction of the press-molded product 100. The first direction as the extension direction of one first surface portion 113*a* and the first direction as the extension direction of the other first surface portion 113*b* may be different from each other.

The second surface portion 114 is connected to the ridge portions 112*a* and 112*b* and is formed so as to intersect the longitudinal direction of the press-molded product 100 and to extend in a second direction different from the first direction. The second surface portion 114 is formed between the ridge portions 112*a* and 112*b*. In this way, the press-molded product 100 has a substantially hat-shaped opened cross-section including the ridge portions 112*a* and 112*b* which extend in the longitudinal direction of the press-molded product 100 and including the first surface portions 113*a* and 113*b* and the second surface portion 114 which are continuous to the ridge portions 112*a* and 112*b*.

(1-2. Inward Continuous Flange)

The press-molded product 100 includes the ridge-portion flanges 115*a* and 115*b*, the first flanges 116*a* and 116*b*, and the second flange 117 provided in at least one outer end portion 100A in the longitudinal direction. The ridge-portion flanges 115*a* and 115*b* are formed at the outer end portion 100A in the longitudinal direction of the ridge portions 112*a* and 112*b*. The first flanges 116*a* and 116*b* are formed in at least a part of the area of the outer end portion 100A in the longitudinal direction of the first surface portions 113*a* and 113*b*. Further, the second flange 117 is formed in at least a part of the area of the outer end portion 100A in the longitudinal direction of the second surface portion 114. In the embodiment, the first flanges 116*a* and 116*b* and the second flange 117 are formed in the entire area of the outer end portion 100A of each of the first surface portions 113*a* and 113*b* and the second surface portion 114.

The ridge-portion flanges 115*a* and 115*b*, the first flanges 116*a* and 116*b*, and the second flange 117 are all formed continuously as the inward flange. The ridge-portion flanges 115*a* and 115*b*, the first flanges 116*a* and 116*b*, and the second flange 117 constitute the inward continuous flange 118. Since the flange provided in the end portion of the press-molded product 100 is formed as the inward continuous flange 118, for example, the cross-section of the vehicle body reinforcing member can be enlarged to the fullest extent of the design cross-section. Thus, it is possible to further improve the bonding strength between the reinforcing member and the other member or the rigidity of the vehicle body.

The press-molded product 100 according to the embodiment includes the inward continuous flange 118 provided in the longitudinal outer end portion 100A so as to be continuous in the entire length of the first surface portions 113*a* and 113*b*, the ridge portions 112*a* and 112*b*, and the second surface portion 114. Here, the first flanges 116*a* and 116*b* and the second flange 117 may be continuous to the ridge-portion flanges 115*a* and 115*b* and the inward continuous flange 118 is not necessarily continuous in the entire length. For example, the first flanges 116*a* and 116*b* or the second flange 117 may be formed in a part of the area of the outer end portion 100A of the first surface portions 113*a* and 113*b* or the second surface portion 114. When the second flange 117 is not formed in the entire area of the second surface portion 114, two divided inward continuous flanges 118 are formed.

When the press-molded product 100 is used as the vehicle body reinforcing member, the press-molded product 100 and the other member can overlap each other with the inward continuous flange 118 interposed therebetween. Then, the press-molded product 100 and the other member are bonded to each other by, for example, spot-welding the inward continuous flange 118.

In addition, when a spot-welding process is performed on the press-molded product 100, for example, the welding process may be performed as below. First, the press-molded product 100 is made to abut on the side surface of the other member and then the inward continuous flange 118 is welded by a C-type spot-welding gun. Subsequently, a closing plate is welded while abutting on the flanges provided in the end portions of the first surface portions 113*a* and 113*b* of the press-molded product 100 in a direction intersecting the extension direction of the ridge portions 112*a* and 112*b*. Accordingly, the opening portion of the hat-shaped press-molded product 100 is closed and the press-molded product 100 is assembled. The same applies to the welding of the closing plate in the other member. When the press-molded product 100 cannot be fixed by the spot-welding gun, the other welding means such as one-way welding, TIG welding, laser welding, and adhering may be used.

(1-3. Ridge-Portion Flange)

In the press-molded product 100 according to the embodiment, it is desirable that the width Lf and the curvature radius rf of each of the ridge-portion flanges 115*a* and 115*b* satisfy Equation (1) as below.

$$0.2\times rf\leq Lf\leq rf \quad (1)$$

When the width Lf of each of the ridge-portion flanges 115*a* and 115*b* is equal to or smaller than the curvature radius rf, the moldability of the inward continuous flange 118 becomes satisfactory while the generation of wrinkles is suppressed. Further, when the width Lf of each of the ridge-portion flanges 115*a* and 115*b* is equal to or larger than 0.2 times the curvature radius rf, it is possible to ensure the rigidity of the ridge-portion flanges 115*a* and 115*b* and to ensure the strength of the press-molded product 100 suitable for the vehicle body reinforcing member.

When the width Lf and the curvature radius rf of each of the ridge-portion flanges 115*a* and 115*b* satisfy Equation (1) above, the flange width of each of the ridge-portion flanges 115*a* and 115*b* may be set to be small so that the ridge-portion flanges do not reach the inner surfaces of the ridge portions 112*a* and 112*b*. That is, the width Lf of each of the ridge-portion flanges 115*a* and 115*b* may be smaller than the widths Lfs1 and Lfs2 of each of the first flanges 116*a* and 116*b* or the second flange 117. Particularly, when a work formed by a high-tensile steel plate or a steel plate having a large plate thickness is used, it is desirable to decrease the flange width Lf of each of the ridge-portion flanges 115*a* and 115*b*.

In the press-molded product 100 according to the embodiment, a concave portion 119 is provided in each of the ridge-portion flanges 115*a* and 115*b*. Accordingly, the width Lf of each of the ridge-portion flanges 115*a* and 115*b* is smaller than the widths Lfs1 and Lfs2 of each of the first flanges 116*a* and 116*b* and the second flange 117 in an area corresponding to the vertex of each of the ridge lines formed by the ridge portions 112*a* and 112*b*. Further, the width of the flange indicates a flat portion except for a curved portion formed in the base portion in which the flange is uprightly formed from the ridge portion, the first surface portion, or the second surface portion.

For example, in the ridge-portion flange 115*a*, as illustrated in FIG. 2(*b*), the width Lf of the ridge-portion flange 115*a* indicates the width Lf of a flat portion 115*aa* except for a curved portion 115*ab* formed so as to be continuous to the ridge portion 112*a* in the longitudinal outer end portion 100A. Since the width Lf of each of the ridge-portion flanges 115*a* and 115*b* is smaller than the widths of the first flanges 116*a* and 116*b* and the second flange 117, the extra extension amount of the front end of the flange of each of the ridge-portion flanges 115*a* and 115*b* is small, and hence the generation of wrinkles is reduced.

(1-4. Plate Thickness Distribution)

Figure 4:
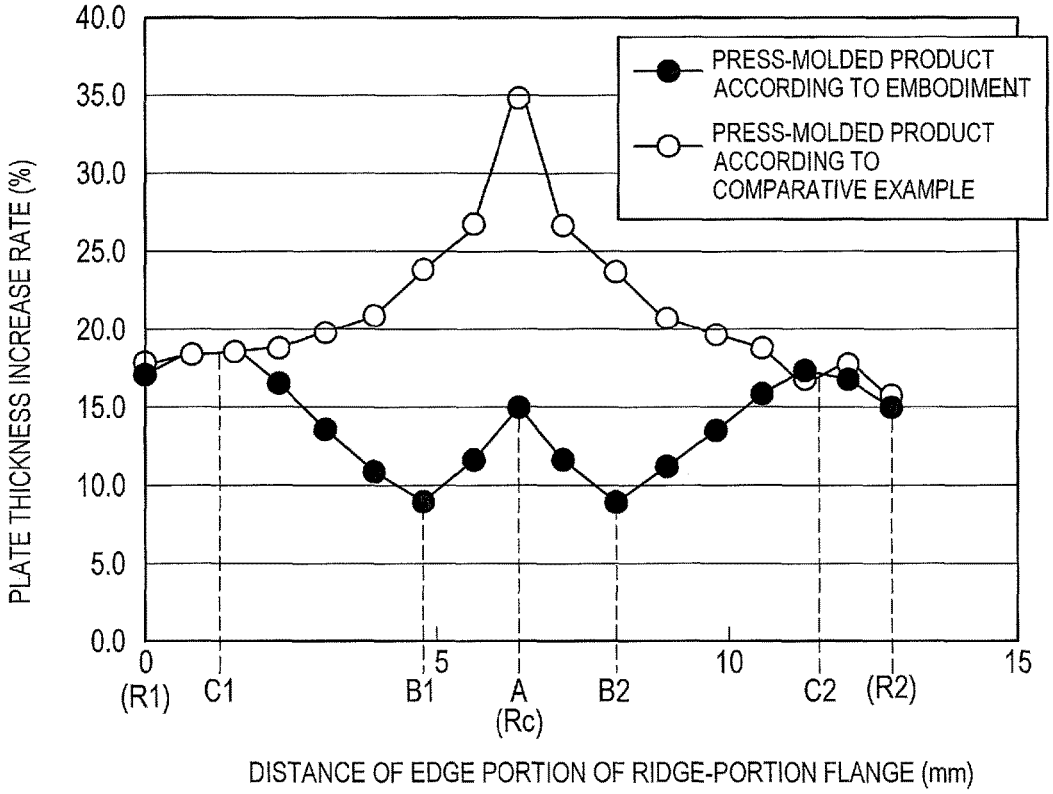
FIG. 4 is a graph illustrating an example of a plate thickness distribution of a ridge-portion flange.

Here, the plate thickness distribution of the ridge-portion flanges 115*a* and 115*b* of the press-molded product 100 according to the embodiment will be described. FIG. 4 is a graph illustrating an example of the plate thickness distribution for the end portion of the ridge-portion flange 115*a* in the width direction. The vertical axis indicates a plate thickness increase rate (%). The plate thickness increase rate indicates the plate thickness increase rate of the end portion of the flange in the width direction based on the plate thickness of the blank to be press-molded.

Further, the horizontal axis indicates the distance (mm) of the edge portion of the ridge-portion flange 115*a*. The "distance of the edge portion of the flange" indicates a position in the circumferential direction from a position in which the plate thickness of the edge portion of the ridge-portion flange 115*a* starts to increase along the ridge line, serving as the starting point 0, to a position in which the plate thickness stops to increase. Specifically, as illustrated in FIG. 2(*b*), the distance indicates a position in the circumferential direction from a plate thickness increase start position R1 to a plate thickness increase end position R2 in the end portion of the ridge-portion flange 115*a* in the width direction. In the example of FIG. 2(*b*), the plate thickness increase start position R1 is located near the first surface portion 113*a*, and the plate thickness increase end position R2 is located near the second surface portion 114. However, the plate thickness increase start position R1 and the plate thickness increase end position R2 may be located at the reverse positions. The intermediate point between the plate thickness increase start position R1 and the plate thickness increase end position R2 indicates a circumferential center portion Rc of the edge portion of the ridge-portion flange 115*a* in the width direction.

As illustrated in FIG. 4, the ridge-portion flange 115*a* of the press-molded product 100 according to the embodiment includes positions C1 and C2 which are provided at both sides of the center area including the circumferential center portion Rc, the plate thickness of the edge portion of the positions C1 and C2 being larger than the plate thickness of the edge portion of the center portion Rc. Specifically, the plate thickness distribution illustrated in FIG. 4 includes a position A which is located at the circumferential center portion Rc so that the plate thickness is maximal, positions B1 and B2 which are located at both sides of the position A so that the plate thickness is minimal, and positions C1 and C2 which are located outside the positions B1 and B2 so that the plate thickness is maximal. That is, the plate thickness is maximal at three positions of the ridge-portion flange 115*a* in the circumferential direction. The plate thickness of each of positions C1 and C2 on both sides between which the center area is interposed is larger than the plate thickness of the circumferential center portion Rc (A).

Since the ridge-portion flanges 115*a* and 115*b* have such a plate thickness distribution, wrinkles generated by the ridge-portion flanges 115*a* and 115*b* are distributed. Accordingly, it is possible to suppress a problem in which buckling wrinkles are intensively generated in the circumferential center area of each of the ridge-portion flanges 115*a* and 115*b*. Thus, when the press-molded product 100 and the other member are bonded to each other by spot-welding through the inward continuous flange 118, a gap is not easily formed between each of the ridge-portion flanges 115*a* and 115*b* and the other member. As a result, the bonding strength can be improved.

Further, it is desirable that a ratio between the maximum value of the position A having a maximal plate thickness in the circumferential center area and the maximum value of each of the positions C1 and C2 provided at both sides of the center area so as to have a maximal plate thickness be substantially in the range of 1.0 to 1.5. Such a ratio can be changed by the curvature radius rf of each of the ridge portions 112*a* and 112*b* or the strength and the work-hardening coefficient of the metal plate (for example, the high-tensile steel plate having a tensile strength of 340 MPa or more) as the blank material of the press-molded product 100.

Since the above-described ratio is in the range of 1.0 to 1.5, the degree of wrinkles generated in the ridge-portion flanges 115*a* and 115*b* decreases. Thus, a gap is not easily formed when the press-molded product 100 is bonded to the other member by spot-welding through the ridge-portion flanges 115*a* and 115*b*, and hence degradation in bonding strength can be suppressed.

As described above, the press-molded product 100 according to the embodiment can be bonded to the other member through the inward continuous flange 118 instead of the outward flange. Thus, the hat-shaped cross-section or the groove-shaped cross-section can be enlarged to the fullest extent of the design cross-section by the area in which the outward flange is not provided. Further, in the press-molded product 100 according to the embodiment, the generation of wrinkles in the inward continuous flange 118 is suppressed without any notch formed in the ridge-portion flanges 115*a* and 115*b*. Thus, when the press-molded product 100 is used as, for example the vehicle body reinforcing member, it is possible to improve the bonding strength between the press-molded product 100 and the other member and to improve the performance involved with the rigidity or the load transfer efficiency of the reinforcing member.

2. Second Embodiment

Next, an example of a method of producing the press-molded product 100 according to a second embodiment of the invention will be described along with a configuration example of an apparatus of producing the press-molded product 100. A method and an apparatus of producing the press-molded product 100 according to the embodiment are used to produce, for example, the press-molded product 100 according to the first embodiment. Hereinafter, an apparatus (hereinafter, also referred to as the "press-molding apparatus") of producing the press-molded product 100 according to the embodiment will be described and then a method of producing the press-molded product 100 using the press-molding apparatus will be described.

(2-1. Press-Molding Apparatus)

Figure 5:
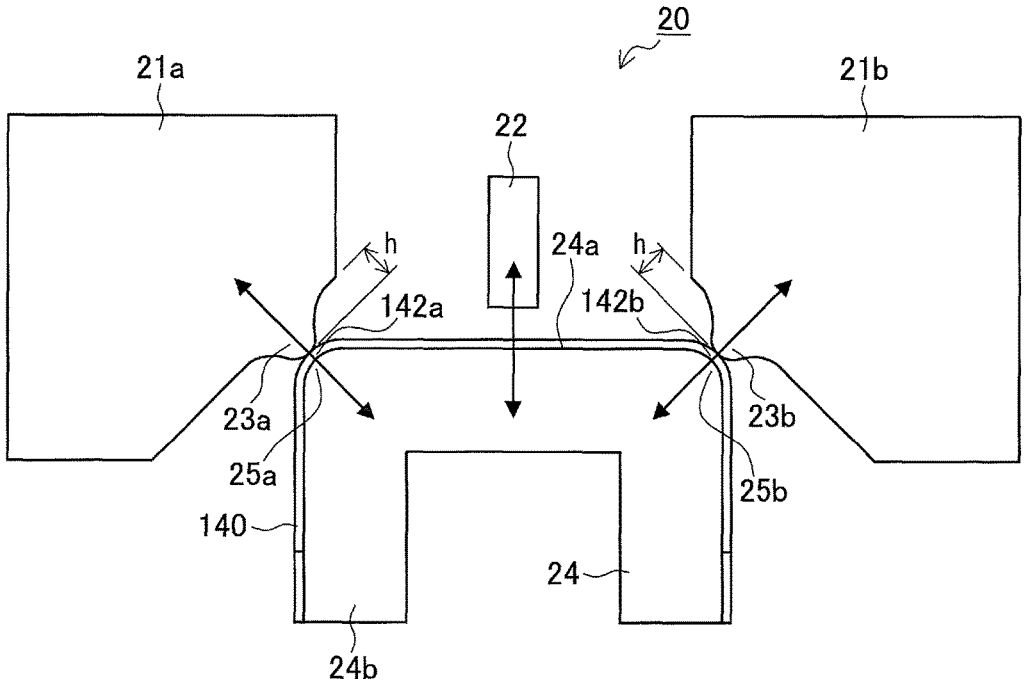
FIG. 5 is a schematic diagram schematically illustrating an entire configuration example of a press-molded product producing apparatus for a bending process.

FIG. 5 is a schematic diagram schematically illustrating an entire configuration example of a press-molding apparatus 20 according to the embodiment. As illustrated in FIG. 5, the press-molding apparatus 20 includes a work supporting tool 24 and first to third bending tools 21*a*, 21*b*, and 22. The work supporting tool 24 is used to fix and support a work 140 having a U-shaped cross-section. The outer surface of the work supporting tool 24 has a shape corresponding to the shape of the inner surface of the work 140 to be supported. The work supporting tool 24 supports the work 140 from the inner area while the end portion forming the flange of the work 140 protrudes outward.

In order to form the inward flange in the end portion of the work 140, the first to third bending tools 21*a*, 21*b*, and 22 are used to press-insert the end portion from the outer area to the inner area of the work 140 so that the work is bent inward. Each of the first to third bending tools 21*a*, 21*b*, and 22 is formed by, for example, a bending blade.

The first to third bending tools 21*a*, 21*b*, and 22 move forward and backward with respect to the work supporting tool 24 so as not to contact the work supporting tool 24. Such a forward and backward movement is realized by, for example, a cam structure (not illustrated). When the first to third bending tools 21*a*, 21*b*, and 22 move forward relatively, at least a part of the bending tools face a side surface 24*b* in a portion causing the end portion of the work 140 to protrude outward in the side surface of the work supporting tool 24. In accordance with such a forward movement, the first to third bending tools 21*a*, 21*b*, and 22 bend the end portion of the work 140 inward.

Further, when the first to third bending tools 21*a*, 21*b*, and 22 move backward relatively, the bending tools move backward to a position not facing the side surface 24*b*. At such a backward movement position, the first to third bending tools 21*a*, 21*b*, and 22 are disposed so as not to be located on the extension line in the longitudinal direction of the work 140. In the press-molding apparatus 20 according to the embodiment, the side surface 24*b* of the work supporting tool is formed on one flat surface, and the first to third bending tools 21*a*, 21*b*, and 22 are provided so as to be movable relatively within a plane parallel to the side surface 24*b*.

The first and second bending tools 21*a* and 21*b* are provided so as to correspond to shoulder portions 25*a* and 25*b* supporting ridge portions 142*a* and 142*b* of the work 140 in the work supporting tool 24. The first and second bending tools 21*a* and 21*b* move forward and backward in a direction in which the shoulder portions 25*a* and 25*b* are divided into two parts in the circumferential direction, that is, a direction in which the ridge lines formed by the ridge portions 142*a* and 142*b* of the work 140 are divided into two parts.

Further, the third bending tool 22 is provided at the substantial center between the first bending tool 21*a* and the second bending tool 21*b*. Such a third bending tool 22 moves forward and backward in a direction orthogonal to a support surface 24*a* of the work supporting tool 24 supporting a second surface portion 144 of the work 140. As described above, the first to third bending tools 21*a*, 21*b*, and 22 are used to press the end portion of the work 140 protruding from the work supporting tool 24 and do not contact the work supporting tool 24.

In a state where the first to third bending tools 21*a*, 21*b*, and 22 move forward relatively so as to face the side surface 24*b* of the work supporting tool 24, it is desirable that the distance x of the gap between each of the first to third bending tools 21*a*, 21*b*, and 22 and the work supporting tool 24 satisfy Equation (3) as below.

$$1.00\times t\leq x\leq 1.40\times t \quad (3)$$

t: plate thickness (mm) of blank w: distance (mm) of gap

Since the distance x of the gap satisfies Equation (3) above, it is possible to suppress the plate thickness of the inward continuous flange 118 from being smaller than the plate thickness before the press-molding process. Further, since the distance x of the gap satisfies Equation (3) above, it is possible to suppress an increase in plate thickness causing the generation of wrinkles in the ridge-portion flanges 115*a* and 115*b*.

Here, the first and second bending tools 21*a* and 21*b* include protrusion portions 23*a* and 23*b* provided at the surfaces in the forward movement direction. Such protrusion portions 23*a* and 23*b* press the end portions of the ridge portions 142*a* and 142*b* in the end portion of the work 140 protruding from the work supporting tool 24 in the plate thickness direction. The end portion of the work 140 protruding from the work supporting tool 24 is a portion bent in the inward continuous flange 118. Further, the end portions of the protruding ridge portions 142*a* and 142*b* are portions formed in the ridge-portion flanges 115*a* and 115*b*.

The first and second bending tools 21*a* and 21*b* are disposed so that the protrusion portions 23*a* and 23*b* contact a part of the end portions of the ridge portions 142*a* and 142*b* from the outer area when the bending process starts. Subsequently, the first and second bending tools 21*a* and 21*b* move forward relatively toward the inner area in the plate thickness direction of the portions contacting the protrusion portions 23*a* and 23*b*. In the end portions of the ridge portions 142*a* and 142*b*, the portions contacting the protrusion portions 23*a* and 23*b* are pressed in the plate thickness direction of the contact portions. Meanwhile, the other parts of the end portions of the ridge portions 142*a* and 142*b* are pressed in a direction intersecting the plate thickness directions of the respective portions.

In this way, when the end portions of the ridge portions 142*a* and 142*b* are pressed by the first and second bending tools 21*a* and 21*b* with the protrusion portions 23*a* and 23*b*, a difference in deformation speed is generated between a portion pressed by the protrusion portions 23*a* and 23*b* and the other portion. Thus, a deformation field obtained when the ridge-portion flanges 115*a* and 115*b* are formed in the end portions of the ridge portions 142*a* and 142*b* is changed from a shrinking deformation field to a shearing deformation field. That is, it is supposed that the deformation state of the ridge-portion flanges 115*a* and 115*b* is changed from the shrinking deformation field (strain ratio $\beta$ ($\varepsilon 2/\varepsilon 1$)<−1: increased plate thickness) to the shearing deformation field (strain ratio $\beta$ ($\varepsilon 2/\varepsilon 1$)≈−1: uniform plate thickness). Thus, it is possible to suppress an increase in plate thickness causing the generation of wrinkles in the end portions of the ridge portions 142*a* and 142*b*.

At this time, when the height h of each of the protrusion portions 23*a* and 23*b* is too small, the shearing deformation field formed in the end portions of the ridge portions 142*a* and 142*b* protruding from the work supporting tool 24 during the bending process performed by the first and second bending tools 21*a* and 21*b* is not sufficient. As a result, there is a case in which an effect of suppressing an increase in plate thickness decreases. Meanwhile, when the height h of each of the protrusion portions 23*a* and 23*b* is too large, there is a concern that the protrusion portions 23*a* and 23*b* may be damaged. Thus, it is desirable that the height h of each of the protrusion portions 23*a* and 23*b* satisfy Equation (2) as below. Further, the sign rf in Equation (2) below indicates the curvature radius of each of the ridge portions 112*a* and 112*b*.

$$0.5\times rf\leq h\leq 3.0\times rf \quad (2)$$

In the embodiment, in the shearing deformation field formed during the bending process performed by the first and second bending tools 21*a* and 21*b*, the strain ratio $\beta$ ($\varepsilon 2/\varepsilon 1$) of the maximal strain portions of the ridge-portion flanges 115*a* and 115*b* satisfies the inequation of $-1.5<(\varepsilon 2/\varepsilon 1)<0.9$. In other words, the protrusion portions 23*a* and 23*b* can give a shearing deformation field in which the strain ratio $\beta$ ($\varepsilon 2/\varepsilon 1$) of the maximal strain portions of the ridge-portion flanges 115*a* and 115*b* satisfies the inequation of $-1.5<(\varepsilon 2/\varepsilon 1)<0.9$.

In addition, the press-molding apparatus 20 may be provided as, for example, a drawing device which draws a blank so as to form the work 140 including the ridge portions 142*a* and 142*b* and the first surface portions 143*a* and 143*b* and the second surface portion 144 being continuous to the ridge portions 142*a* and 142*b*. For example, the press-molding apparatus 20 according to the embodiment may be provided as an existing drawing device 50 including a die 51, a punch 53, and a blank holder 55 illustrated in the example of FIG. 6. Alternatively, the press-molding apparatus 20 according to the embodiment may be provided as an existing bending device 60 including a die 61 and a punch 63 illustrated in the example of FIG. 7.

In this case, the press-molding apparatus 20 is provided in a manner that the first to third bending tools 21*a*, 21*b*, and 22 are disposed near the side surface of the die 51 or 61 and the bending tools 21*a*, 21*b*, and 22 are set to be movable relative to the punch 53 or 63. According to such a press-molding apparatus 20, since the punch serves as the work supporting tool 24, there is no need to use the dedicated work supporting tool 24. Thus, it is possible to reduce the producing cost and the number of the production steps of the press-molded product 100 compared with the case where the dedicated work supporting tool 24 is used.

Further, the press-molding apparatus 20 according to the embodiment is provided as a bending device for bending the work 140 with two ridge portions 142*a* and 142*b*. Such a press-molding apparatus 20 includes the first and second bending tools 21*a* and 21*b* which bend the end portions of the ridge portions 142*a* and 142*b* and the third bending tool 22 which bends the end portion of the second surface portion 144 of the work 140. Here, the press-molding apparatus 20 is not limited to such an example.

For example, the third bending tool 22 which bends the end portion of the second surface portion 144 may be omitted when the width of the second surface portion 144 is small. Further, for example, when a work having a V-shaped cross-section with one ridge portion is bent, the press-molding apparatus may not include the third bending tool 22. In this case, in order to press the end portion of the ridge portion so that the end portion is bent inward, the press-molding apparatus may include only the first bending tool 21*a* with the protrusion portion 23*a*.

(2-2. Press-Molded Product Producing Method)

Next, a method of producing the press-molded product 100 by bending the end portion of the work 140 having a U-shaped cross-section using the press-molding apparatus 20 according to the embodiment will be described.

Figure 8:
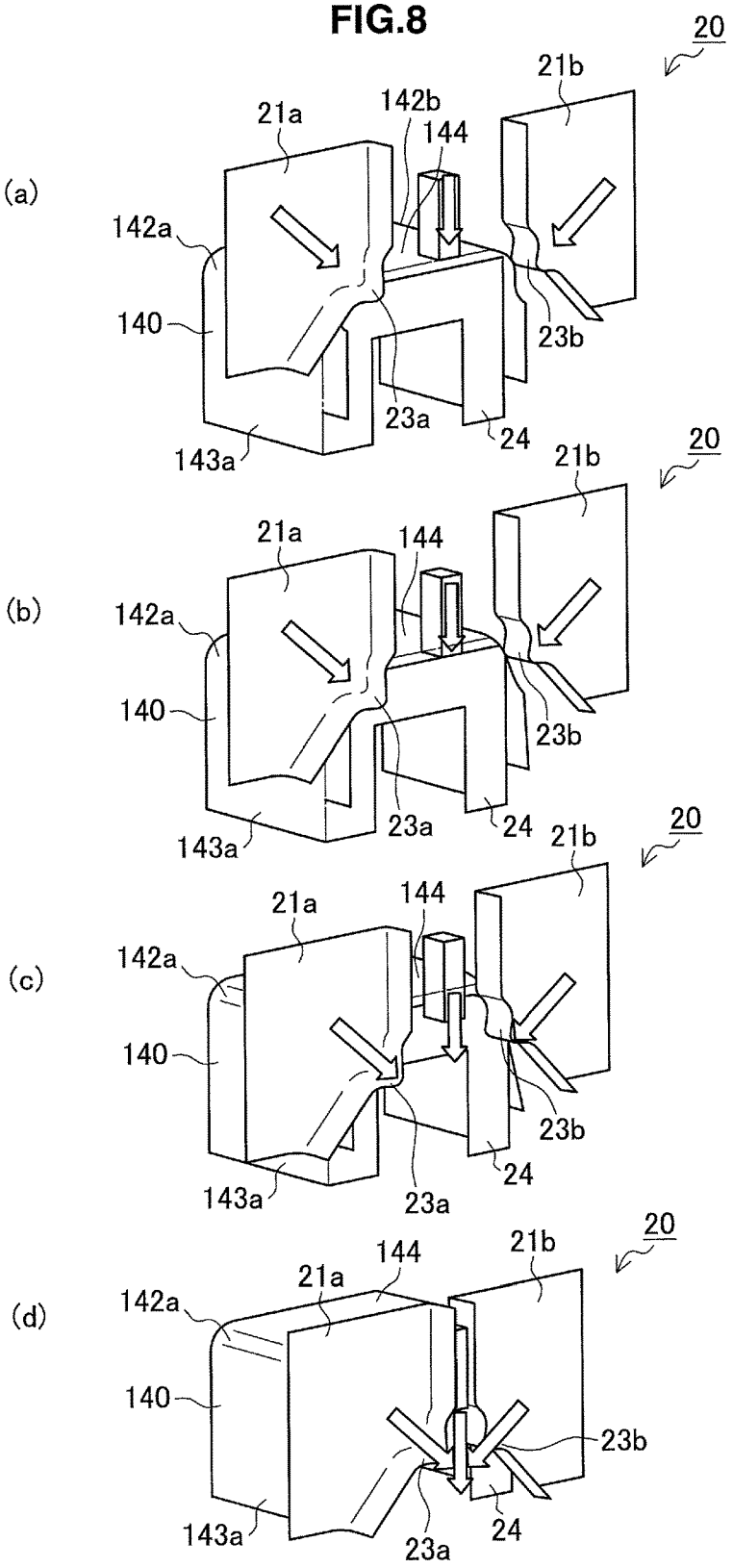
FIG. 8(*a*) is a diagram illustrating a state where a work is attached to a work supporting tool, FIG. 8(*b*) is a diagram illustrating a state where a bending process starts, FIG. 8(*c*) illustrates a state where the bending process is being performed, and FIG. 8(*d*) is a diagram illustrating a state where the bending process ends.

FIG. 8 is an explanatory diagram schematically illustrating a state where the press-molded product 100 is produced from the work 140 by the method of producing the press-molded product 100 according to the embodiment. FIG. 8(*a*) illustrates a state where the work 140 is attached to the work supporting tool 24 and FIG. 8(*b*) illustrates a state where the bending process for the work 140 starts. Further, FIG. 8(*c*) illustrates a state where the work 140 is bent and FIG. 8(*d*) illustrates a state where the bending process for the work 140 ends.

Figure 9:
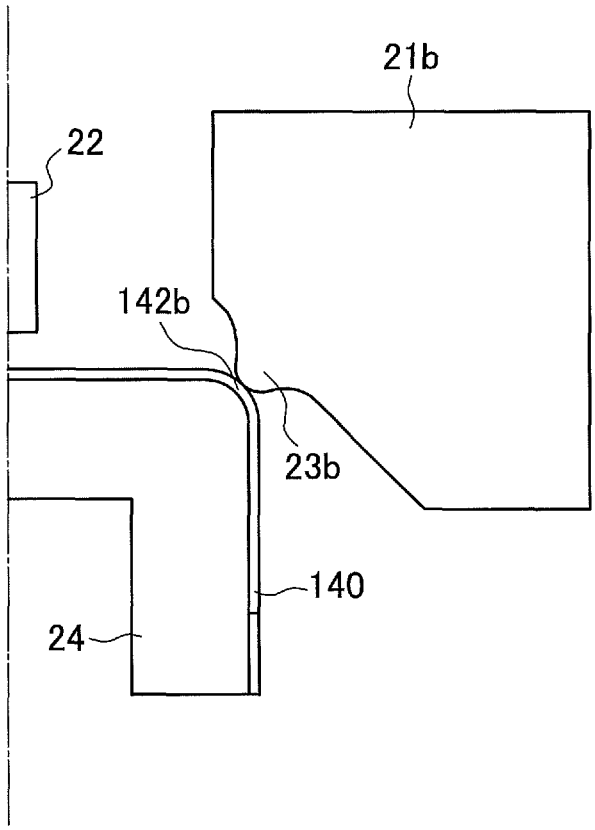
FIG. 9 is an explanatory diagram illustrating a state where a protrusion portion provided in a surface of a bending tool contacts an end portion of a ridge portion.
Figure 10:
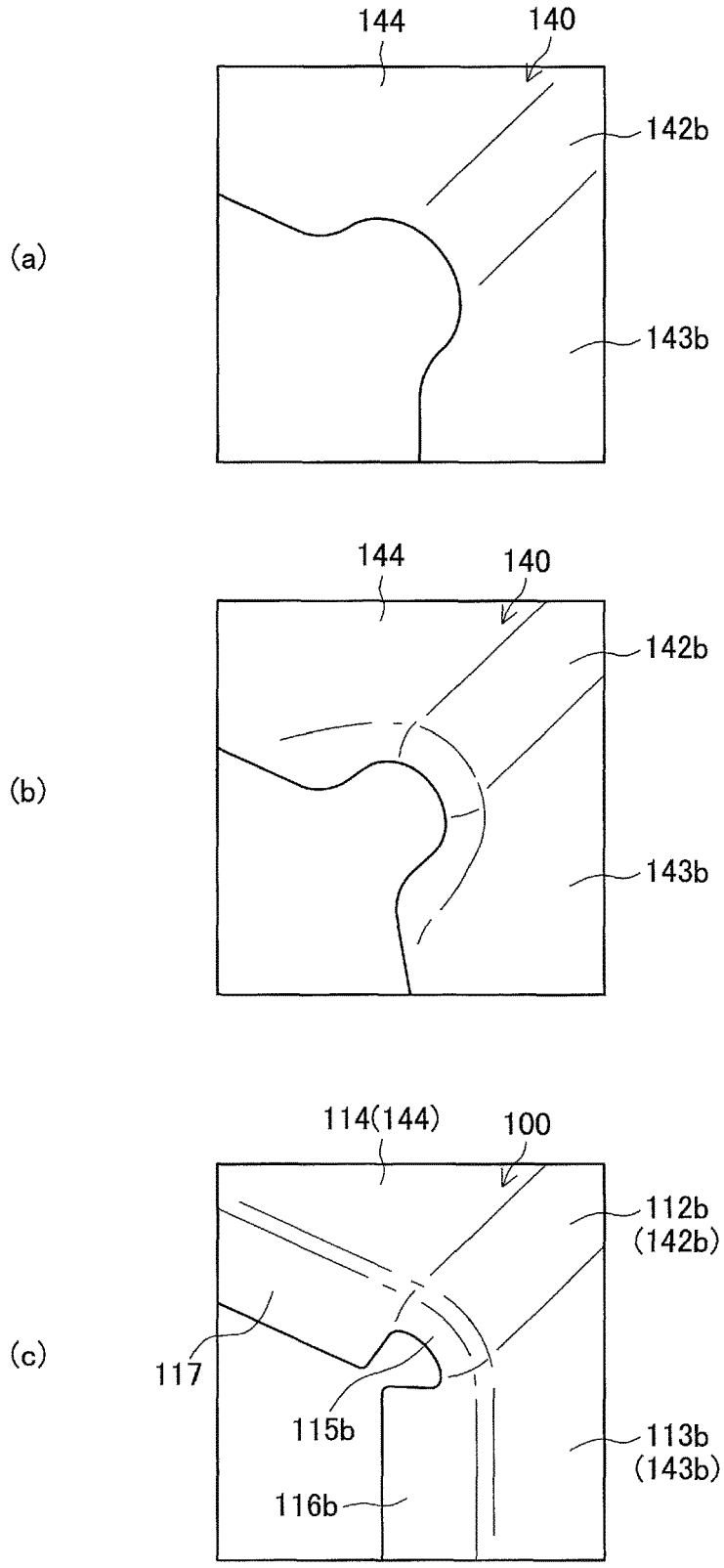
FIG. 10(*a*) is a perspective view illustrating an end portion of a work to be bent, FIG. 10(*b*) is a perspective view illustrating the end portion of the work of which a ridge portion is being bent, and FIG. 10(*c*) is a perspective view illustrating the end portion of the work when the bending process ends.

Further, FIG. 9 is an explanatory diagram illustrating a state where the protrusion portions 23*a* and 23*b* provided in the surfaces of the first and second bending tools 21*a* and 21*b* contact the work 140 and the protrusion portions 23*a* and 23*b* press the contact portion of the work 140 in the plate thickness direction. In addition, FIG. 10 is a perspective view illustrating a state where the end portion of the work 140 is deformed by the method of producing the press-molded product 100 according to the embodiment. FIG. 10(*a*) illustrates the end portion of the work 140 to be bent, FIG. 10(*b*) illustrates the end portion of the work 140 of which the ridge portion is being bent, and FIG. 10(*c*) illustrates the end portion of the work 140 when the bending process ends.

As illustrated in FIG. 8(*a*), the work 140 has a U-shaped cross-section with the ridge portions 142*a* and 142*b* extending in the longitudinal direction and the first surface portions 143*a* and 143*b* and the second surface portion 144 being continuous to both ends of the ridge lines formed by the ridge portions 142*a* and 142*b*. In a state where the longitudinal end portion 140*a* of such a work 140 protrudes from the work supporting tool 24, the work 140 is fixed and supported while being covered by the work supporting tool 24. The protruding end portion 140*a* is a portion to be bent in the inward continuous flange 118. As illustrated in FIG. 10(*a*), the end portion of the work 140 is not bent at the step in which the bending process is not started yet.

At that time, as illustrated in FIGS. 8(*a*) and 9, the first and second bending tools 21*a* and 21*b* are disposed so that the front ends of the protrusion portions 23*a* and 23*b* provided in the respective surfaces of the first and second bending tools 21*a* and 21*b* contact the end portions of the ridge portions 142*a* and 142*b* of the work 140. In the embodiment, the protrusion portions 23*a* and 23*b* contact the center portion dividing the ridge line into two parts in the end portions of the ridge portions 142*a* and 142*b*. Further, the third bending tool 22 is disposed so as to contact the substantial center portion of the end portion of the second surface portion 144 interposed between two ridge portions 142*a* and 142*b*.

Next, as illustrated in FIG. 8(*b*), the first and second bending tools 21*a* and 21*b* are moved from the outer area toward the inner area of the work 140 in the inclination direction inclined with respect to the vertical direction by, for example, a cam mechanism (not illustrated). Accordingly, the front ends of the protrusion portions 23*a* and 23*b* press the circumferential center portions of the end portions of the ridge portions 142*a* and 142*b* in the plate thickness direction. That is, as indicated by the white arrow of FIG. 8(*b*), the first and second bending tools 21*a* and 21*b* move in the inclination direction substantially dividing the ridge lines of the end portions of the ridge portions 142*a* and 142*b* into two parts.

Accordingly, the circumferential center areas of the end portions of the ridge portions 142*a* and 142*b* start to be deformed earlier than the other areas. At the same time, the third bending tool 22 is similarly moved in the vertical direction by a cam mechanism (not illustrated), and the front end of the third bending tool 22 contacts the center portion of the end portion of the second surface portion 144. At this time, it is desirable that the protrusion portions 23*a* and 23*b* of the first and second bending tools 21*a* and 21*b* press a part or the entirety of an area substantially having a width of the plate thickness and including the circumferential center portion and both sides of the circumferential center portion of each of the end portions of the ridge portions 142*a* and 142*b* in the plate thickness direction of the corresponding portion.

With such a bending process, positions having a maximal plate thickness and formed in each of the edge portions of the ridge-portion flanges 115*a* and 115*b* in the width direction can be easily distributed evenly in the circumferential direction of the ridge-portion flanges 115*a* and 115*b*. Thus, the generation of wrinkles in the ridge-portion flanges 115*a* and 115*b* is further suppressed. From such a viewpoint, it is more desirable to press and bend the circumferential center portions of the ridge portions 142*a* and 142*b* in the plate thickness direction by the protrusion portions 23*a* and 23*b*.

Next, as illustrated in FIGS. 8(*c*) and 8(*d*), the first to third bending tools 21*a*, 21*b*, and 22 are moved in the directions indicated by the white arrows so as to bend the end portions of the work 140. That is, when the third bending tool 22 is moved, the end portion of the second surface portion 144 is bent inward in the plate thickness direction. Further, when the first and second bending tools 21*a* and 21*b* are moved, the circumferential center portions of the end portions of the ridge portions 142*a* and 142*b* are bent in the plate thickness direction. Further, in accordance with the movement of the first and second bending tools 21*a* and 21*b*, the other portion except for the circumferential center portions of the end portions of the ridge portions 142*a* and 142*b* are sequentially pressed from the center portions at the timing later than the timing of pressing the circumferential center portions. Accordingly, the other portions except for the center portions of the ridge portions 142*a* and 142*b* are sequentially bent in a direction intersecting the plate thickness direction of the corresponding portion.

That is, in the method of producing the press-molded product 100 according to the embodiment, as illustrated in FIG. 10(*b*), the end portion of the ridge portion 142*b* among the end portions of the work 140 is bent first. Subsequently, as illustrated in FIG. 10(*c*), the end portions of the first surface portion 143*b* and the second surface portion 144 are sequentially bent so as to form the inward continuous flange 118.

In the method of producing the press-molded product 100 according to the embodiment, the circumferential center areas of the end portions of the ridge portions 142*a* and 142*b* start to be deformed earlier than the other areas, so that the deformation speed of the center area becomes different from the deformation speed of the portion other than the center area. For that reason, the deformation field of each of the ridge-portion flanges 115*a* and 115*b* is changed from the deformation field as the shrinking flange deformation field having a large increase in plate thickness to the pure shearing deformation field, and hence an increase in plate thickness easily causing the generation of wrinkles is suppressed. In this way, it is possible to obtain the press-molded product 100 with the inward continuous flange 118 in which each of the ridge-portion flanges 115*a* and 115*b* is not provided with the notch and the generation of wrinkles is suppressed.

In the description above, an example is described in which the protrusion portions 23*a* and 23*b* press the circumferential center portions of the end portions of the ridge portions 142*a* and 142*b* of the work 140 in the plate thickness direction, but the embodiment is not essentially limited to such an example. As long as the circumferential center areas of the end portions of the ridge portions 142*a* and 142*b* are guaranteed, the positions other than the center portions dividing the ridge lines into two parts may be pressed in the plate thickness direction.

According to the method and the apparatus of producing the press-molded product 100 according to the embodiment, a shearing deformation field is formed in each of the ridge-portion flanges 115*a* and 115*b* formed in the end portions of the ridge portions 142*a* and 142*b* of the work 140 during the bending process. Thus, it is possible to effectively suppress an increase in plate thickness of the ridge-portion flanges 115*a* and 115*b* caused by the shrinking deformation in accordance with the bending deformation.

Figure 6:
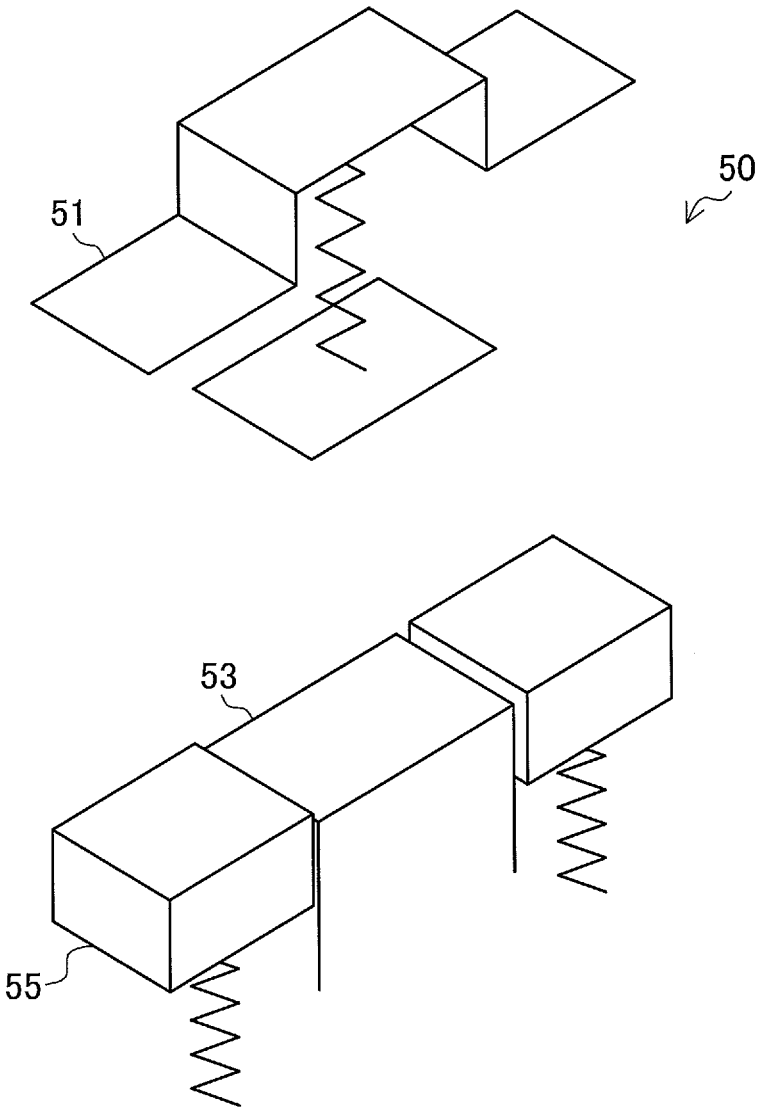
FIG. 6 is an explanatory diagram schematically illustrating an example of a drawing device.
Figure 7:
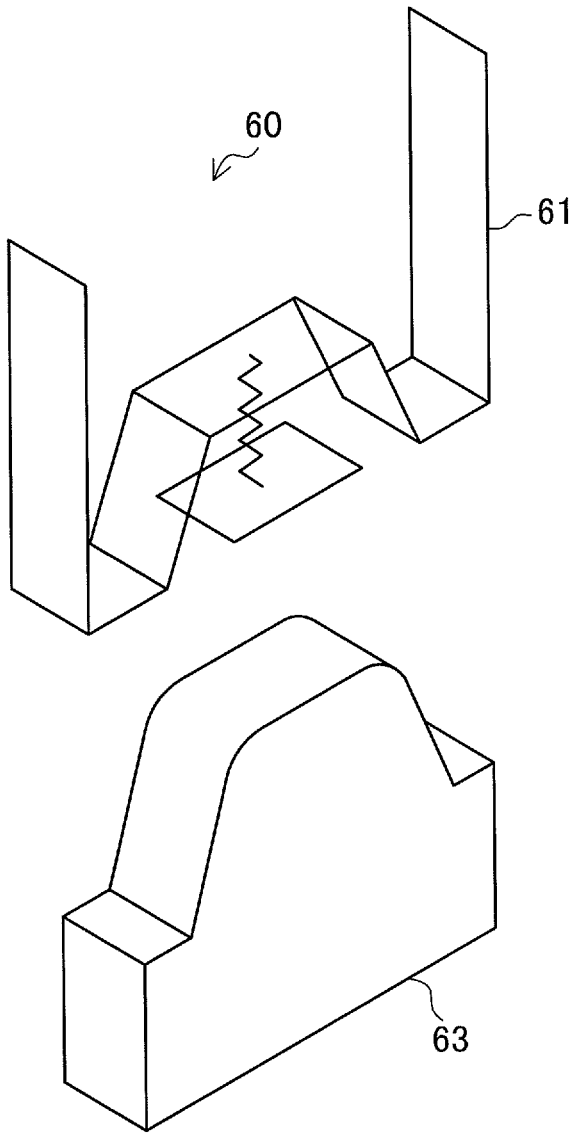
FIG. 7 is an explanatory diagram schematically illustrating an example of a bending device.

In addition, when the press-molding apparatus 20 is provided by using the existing drawing device or the bending device illustrated in FIG. 6 or 7, it is possible to mold the work 140 and the inward continuous flange 118 according to a series of processes as below. For example, first, the work 140 is molded by drawing or bending a blank. Next, in a state where the work 140 is not separated from the press-molding apparatus 20, the longitudinal end portion of the work 140 is bent inward by the first to third bending tools 21*a*, 21*b*, and 22 disposed near the side surface of the die 51 or 61 by using the punch 53 or 63 as the work supporting tool 24.

In this way, it is possible to obtain the press-molded product 100 with the inward continuous flange 118 through a series of processes. In this way, since the press-molded product 100 is produced by using the single press-molding apparatus 20, it is possible to produce the press-molded product 100 at low cost and a small number of steps.

Further, in order to process (hereinafter, "trim") each of the ridge-portion flanges 115*a* and 115*b* into a predetermined shape when the concave portion 119 is formed in each of the ridge-portion flanges 115*a* and 115*b*, for example, the press-molded product 100 can be produced according to the following procedures.

(1) The work 140 having a predetermined cross-section shape is molded, the longitudinal end portions of the ridge portions 142*a* and 142*b* of the work 140 are trimmed, and then the end portions of the work 140 are bent inward.

(2) The work 140 is molded and trimmed from the blank so as to mold the work 140 of which the longitudinal end portions of the ridge portions 142*a* and 142*b* are processed into a predetermined shape, and then the end portions of the work 140 are bent inward.

(3) A portion molded into the ridge-portion flange in the blank is trimmed so as to process the blank into a predetermined shape, the work 140 is then molded from the blank, and the end portion of the work 140 is bent inward.

EXAMPLES

Hereinafter, Examples of the invention will be described with reference to a numerical analysis result based on the finite element method.

Examples 1 to 5 and Comparative Examples 1 to 5

First, a work having a V-shaped cross-section and formed by a high-tensile steel plate with a plate thickness of 1.6 mm and a tensile strength of 980 MPa was used, and the end portion of the work was bent according to the procedure illustrated in FIGS. 5 to 9 so as to produce a press-molded product having an inward continuous flange. The deformation behavior of each of a ridge-portion flange and adjacent first and second flanges during the production of the press-molded product was analyzed by a numerical analysis.

Figure 11:
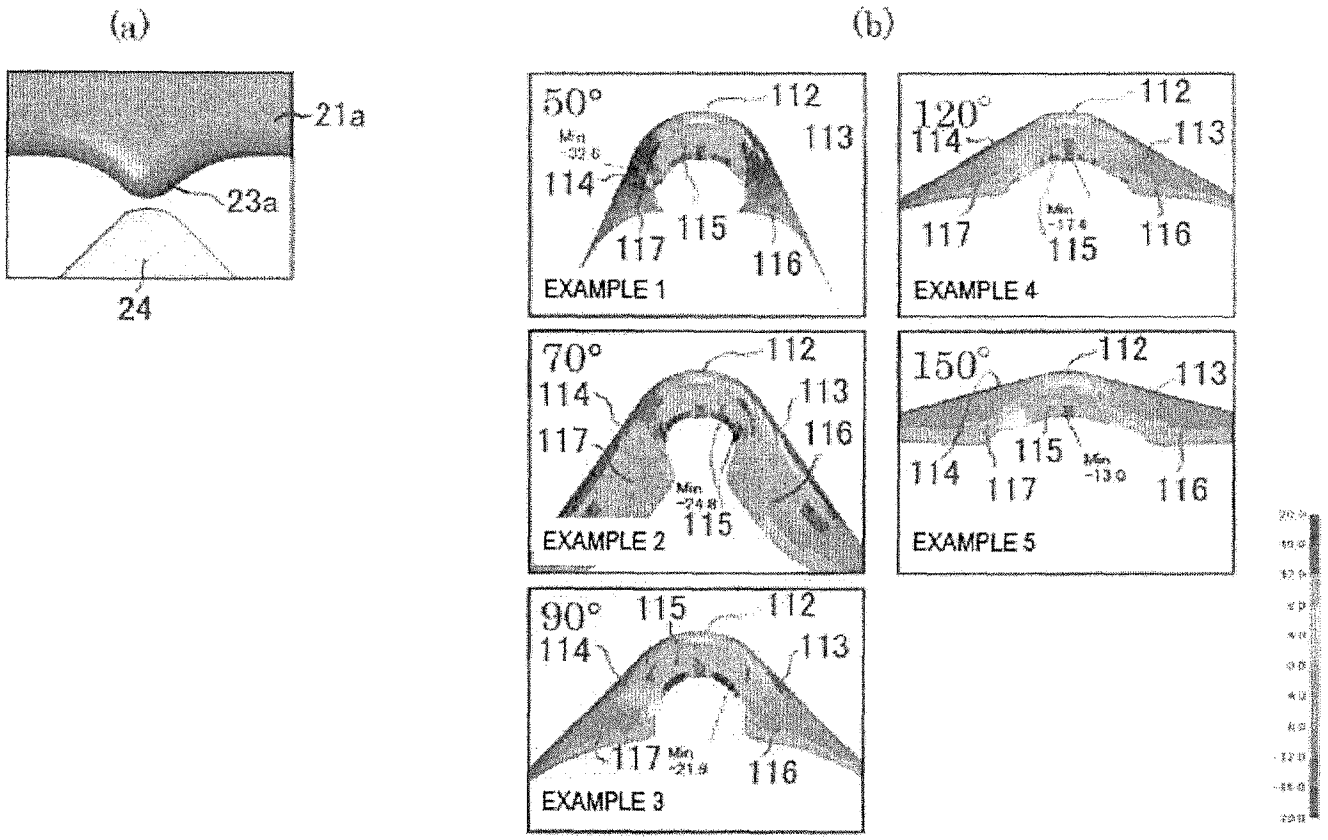
FIG. 11(*a*) is a diagram schematically illustrating a shape of a bending tool with a protrusion portion and FIG. 11(*b*) is an explanatory diagram illustrating a flange deformation state in the vicinity of a ridge-portion flange.

FIG. 11 is an explanatory diagram illustrating Example of the invention in which a bending process is performed by the first bending tool 21*a* with the protrusion portion 23*a*. FIG. 11(*a*) is a diagram illustrating a shape of the first bending tool 21*a*. In the first bending tool 21*a*, the height h of the protrusion portion 23*a* is 7 mm, and the curvature radius of the front end of the protrusion portion 23*a* is 6 mm. FIG. 11(*b*) is an explanatory diagram illustrating the deformation state of the ridge-portion flange 115, the first flange 116, and the second flange 117 of the press-molded product in Examples 1 to 5. At the upper left side of the drawing of FIG. 11(*b*), a V-shaped angle (hereinafter, also referred to as a "ridge inner angle") formed by the first surface portion 113 and the second surface portion 114 is illustrated.

Figure 12:
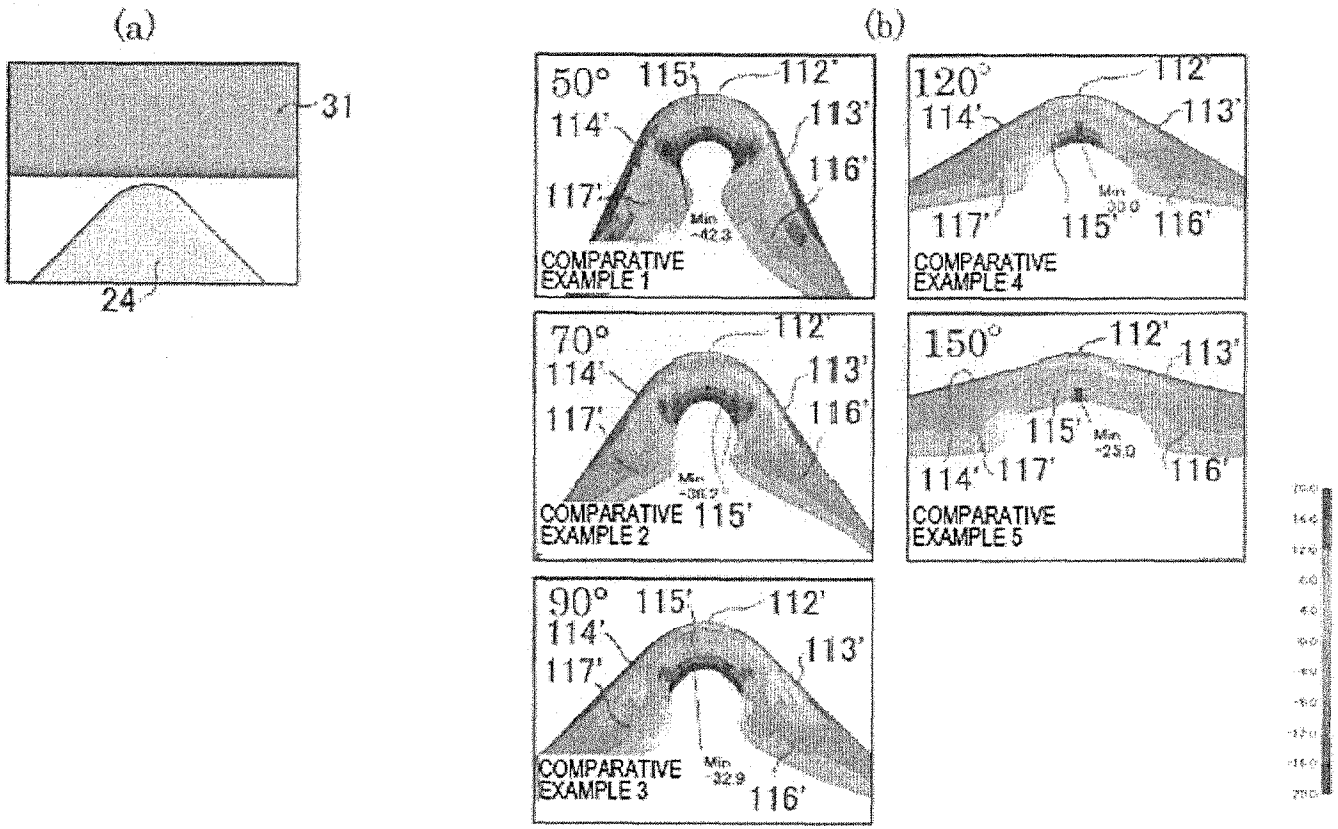
FIG. 12(*a*) is a diagram schematically illustrating a shape of a straight bending tool without a protrusion portion and FIG. 12(*b*) is an explanatory diagram illustrating a flange deformation state in the vicinity of a ridge-portion flange.

FIG. 12 is an explanatory diagram illustrating Comparative Example in which a bending process is performed by a straight bending tool 31 without a protrusion portion. FIG. 12(*a*) is an explanatory diagram illustrating a shape of the bending tool 31. FIG. 12(*b*) is an explanatory diagram illustrating the deformation state of a ridge-portion flange 115', a first flange 116', and a second flange 117' of Comparative Examples 1 to 5. At the upper left side of the drawing of FIG. 12(*b*), a V-shaped ridge inner angle formed by a first surface portion 113' and a second surface portion 114' is illustrated.

In Example 1 and Comparative Example 1, the ridge inner angle of the press-molded product is 60°. In Example 2 and Comparative Example 2, the ridge inner angle of the press-molded product is 70°. In Example 3 and Comparative Example 3, the ridge inner angle of the press-molded product is 90°. In Example 4 and Comparative Example 4, the ridge inner angle of the press-molded product is 120°. In Example 5 and Comparative Example 5, the ridge inner angle of the press-molded product is 150°.

Figure 13:
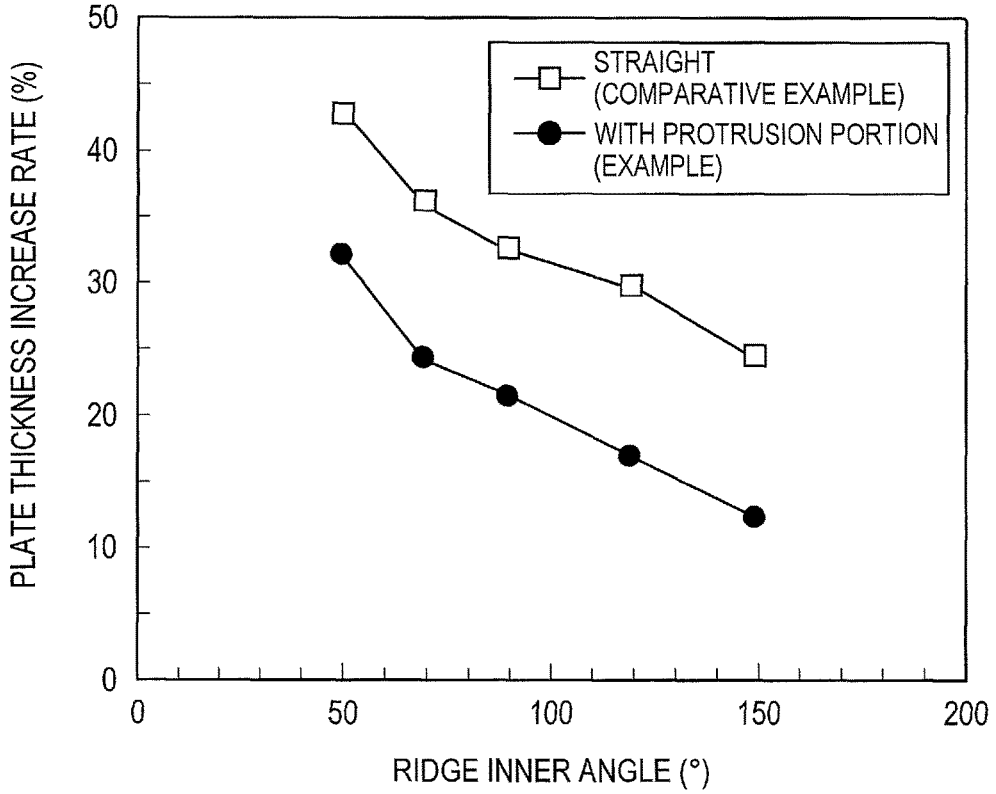
FIG. 13 is a graph illustrating a plate thickness increase rate of a ridge-portion flange in accordance with a bending process.

FIG. 13 is a graph in which the plate thickness increase rates of the edge portions of the ridge-portion flanges 115 and 115' in the width direction are respectively correlated with Example and Comparative Example. The vertical axis indicates the maximum value of the plate thickness increase rate, and the horizontal axis indicates the ridge inner angle.

The plate thickness increase rate indicates the plate thickness increase rate after the bending process based on the plate thickness (1.6 mm) of the blank.

As illustrated in FIGS. 11(*b*) and 12(*b*), in the press-molded products of Examples 1 to 5, the plate thickness increase rate of the ridge-portion flange 115 is suppressed so as to be small compared with the press-molded products having the same ridge inner angle of Comparative Examples 1 to 5. Further, as illustrated in the graph of FIG. 13, in the press-molded products of Examples 1 to 5, the plate thickness increase rate of the ridge-portion flange 115 is largely suppressed compared with the press-molded products having the same ridge inner angle of Comparative Examples 1 to 5. Thus, according to the invention, it is understood that the press-molded product having the inward continuous flange 118 with a satisfactory shape can be produced while an increase in plate thickness of the ridge-portion flange 115 is small and a difference in plate thickness distribution is small.

Examples 6 and 7

Next, in Example 6, a work having a V-shaped cross-section and formed by a high-tensile steel plate with a plate thickness of 1.0 mm and a tensile strength of 980 MPa was used, and a press-molded product having an inward continuous flange was produced according to the procedure illustrated in FIGS. 5 to 9. Further, in Example 7, a work having a U-shaped cross-section and formed by a high-tensile steel plate with a plate thickness of 1.0 mm and a tensile strength of 980 MPa was used, and a press-molded product having an inward continuous flange was produced according to the procedures illustrated in FIGS. 5 to 9. The plate thickness distribution of the edge portion of the ridge-portion flange in the width direction during the production of the press-molded product was analyzed by a numerical analysis.

FIGS. 14(*a*) and 14(*b*) are external views illustrating press-molded products 120 and 130 in which the inward continuous flanges are formed by a bending process. FIG. 15 is a graph illustrating the plate thickness distribution in the width direction of the edge portion of the inward continuous flange 118 formed in the end portion in the extension direction of the ridge portion 112 of the press-molded product 120 or 130. In the graph of FIG. 15, the vertical axis indicates the plate thickness increase rate (%). Further, the horizontal axis indicates the distance (mm) of the edge portion of the ridge-portion flange 115.

As illustrated in the graph of FIG. 15, according to the press-molded product producing method of the invention, it is proved that the plate thickness increase rate of a part of both sides of the center portion is larger than the plate thickness increase rate of the circumferential center portion Rc in the edge portion of the inward ridge-portion flange 115. Further, it is understood that the plate thickness increase rate of the edge portion of the inward ridge-portion flange 115 is maximal at three positions. Thus, the press-molded product producing method of the invention can suppress the generation of buckling wrinkles at the circumferential center area of the ridge-portion flange 115. Accordingly, when the press-molded product is used as, for example, the vehicle body reinforcing member, it is possible to improve the bonding strength between the press-molded product and the other member and to improve the performance involved with the rigidity or the load transfer efficiency of the reinforcing member.

REFERENCE SIGNS LIST

20 press-molding apparatus
21*a* first bending tool
21*b* second bending tool
22 third bending tool
23*a*, 23*b* protrusion portion
24 work supporting tool
24*a* support surface
24*b* side surface
25*a*, 25*b* shoulder portion
31 bending tool
50 drawing device
60 bending device
100, 120, 130 press-molded product
100A outer end portion
112*a*, 112*b* ridge portion
113*a*, 113*b* first surface portion
114 second surface portion
115, 115', 115*a*, 115*b* ridge-portion flange
115*aa* flat portion
115*ab* curved portion
116, 116', 116*a*, 116*b* first flange
117, 117' second flange
118 inward continuous flange
119 concave portion
140 work
140*a* longitudinal end portion
142*a*, 142*b* ridge portion
143*a*, 143*b* first surface portion
144 second surface portion

The invention claimed is:

1. A press-molded product of a metal plate which is formed by a steel plate having a tensile strength of 340 MPa or more and includes a ridge portion extending in a predetermined direction and first and second surface portions respectively extending from both ends of a ridge line formed by the ridge portion, the press-molded product comprising:

an inward continuous flange in at least one end portion in the predetermined direction, wherein the inward continuous flange is obtained by continuously forming a ridge-portion flange formed inward in an end portion of the ridge portion, a first flange formed inward in at least a part of an area of an end portion of the first surface portion, and a second flange formed inward in at least a part of an area of an end portion of the second surface portion, and wherein the ridge-portion flange has a center area including a circumferential center area, a first area on one side of the center area, and a second area on the other side of the center area, wherein regarding a plate thickness of an edge portion of the ridge-portion flange, the ridge-portion flange has a plate thickness distribution in which a plate thickness of a portion of each of the first area and the second area is equal to or larger than a plate thickness of the center area.

2. The press-molded product according to claim 1, wherein the ridge-portion flange has a maximal plate thickness at three positions, one in each of the center area, the first area and the second area, and the plate thickness of the positions of the first area and the second area having a maximal plate thickness is larger than the plate thickness of the position of the center area having a maximal plate thickness.

3. The press-molded product according to claim 1, wherein a flange width of at least a part of the ridge-portion flange is smaller than a flange width of each of the first flange and the second flange.

4. The press-molded product according to claim 1, wherein a flange width (Lf) of the ridge-portion flange and a curvature radius (rf) of a curvature of the ridge portion satisfy Equation (1) below:

$$0.2 \times rf \leq Lf \leq rf \quad (1).$$

5. The press-molded product according to claim 1, wherein a cross-section of the press-molded product when viewed in the predetermined direction is a substantially hat-shaped or groove-shaped opened cross-section or a closed cross-section.

6. The press-molded product according to claim 1, wherein the press-molded product is a vehicle body reinforcing member.

* * * * *